US007384891B2

(12) United States Patent
Natsui et al.

(10) Patent No.: US 7,384,891 B2
(45) **Date of Patent: *Jun. 10, 2008**

(54) THERMAL RECORDING MEDIUM

(75) Inventors: Junpei Natsui, Tokyo (JP); Yuji Tsuzuki, Tokyo (JP); Kaoru Hamada, Tokyo (JP); Takashi Date, Tokyo (JP)

(73) Assignee: Nippon Paper Industries Co., Ltd. (JP)

( * ) Notice: Subject to any disclaimer, the term of this patent is extended or adjusted under 35 U.S.C. 154(b) by 159 days.

This patent is subject to a terminal disclaimer.

(21) Appl. No.: 10/519,188

(22) PCT Filed: Jun. 27, 2003

(86) PCT No.: PCT/JP03/08235

§ 371 (c)(1),
(2), (4) Date: Dec. 22, 2004

(87) PCT Pub. No.: WO2004/002748

PCT Pub. Date: Jan. 8, 2004

(65) Prior Publication Data

US 2005/0264644 A1 Dec. 1, 2005

(30) Foreign Application Priority Data

Jun. 27, 2002 (JP) ..... 2002-188548
Aug. 30, 2002 (JP) ..... 2002-255188
Aug. 30, 2002 (JP) ..... 2002-255193
Sep. 30, 2002 (JP) ..... 2002-286841

(51) Int. Cl.
*B41M 5/337* (2006.01)

(52) U.S. Cl. ..... 503/209; 503/216

(58) Field of Classification Search ..... 503/200–226
See application file for complete search history.

(56) References Cited

U.S. PATENT DOCUMENTS 5,665,675 A * 9/1997 Nagai et al. ..... 503/216
5,733,843 A * 3/1998 Minami et al. ..... 503/209
5,811,368 A * 9/1998 Fukuchi et al. ..... 503/209
5,811,369 A * 9/1998 Nagai et al. ..... 503/209
6,846,619 B2 * 1/2005 Kaneko et al. ..... 430/338

FOREIGN PATENT DOCUMENTS

JP 04-164685 * 6/1992
JP 2002-178646 * 6/2002
WO 00/14058 * 3/2000

* cited by examiner

*Primary Examiner*—Bruce H Hess
(74) *Attorney, Agent, or Firm*—H. Jay Spiegel; Robert L. Haines

(57) ABSTRACT

Provided is a thermally sensitive recording medium which exhibits high recording sensitivity, high heat resistance of ground color part and excellent preserving stability of images. A thermally sensitive recording medium, comprising a thermally sensitive recording layer containing a colorless or pale colored basic colorless dye and an organic color developing agent as main components on a substrate, wherein said thermally sensitive recording layer contains at least one compound represented by general formula (1) and contains at least one compound selected from the group consisting of 3-{[(phenylamino)carbonyl]amino}benzensulfoneamide represented by formula (2), an ureaurethane compound represented by formula (3) and a copolymer of glysidilmethacrylate and vinyl monomer (average molecular weight is 9000-11000, epoxy equivalent is 300-600 and melting point is 110° C. or less) as a stabilizer.

(1)

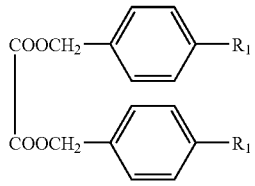

(in the formula, $R_1$ is a hydrogen atom, a halogen atom, an alkyl group or alkoxy group)

(2)

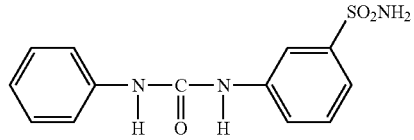

(3)

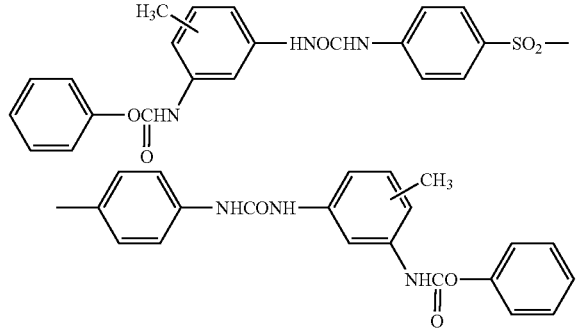

As a color developing agent a compound represented by general formula (4) is desirable.

(4)

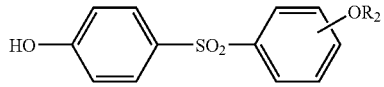

(in the formula, $R_2$ is an alkyl group of carbon number 1-4, an alkoxy group, a phenyl group or a hydrogen atom).

2 Claims, No Drawings

THERMAL RECORDING MEDIUM

FIELD OF THE INVENTION

The present invention relates to a thermally sensitive recording medium which utilizes coloring reaction of a basic colorless dye with an organic color developing agent.

BACKGROUND OF THE INVENTION

In general, a thermally sensitive recording medium is prepared by following process. That is, after a colorless or pale colored basic colorless dye and an organic color developing agent are respectively ground to fine particles, these particles are mixed together with and additives such as a binder, a filler, a sensitizer and a slipping agent or others are added and obtain a coating, then the obtained coating is coated on a substrate such as a paper, a synthetic paper, a film or a plastic. The thermally sensitive recording medium develops color by instant chemical reaction caused by heating with a thermal head, a hot stamp, a thermal pen or laser beam. Usually, a thermally sensitive recording medium is broadly applied for a facsimile use, a terminal printer of a computer, an automatic bending machine for tickets and a recorder of a measuring instrument, and the use is extending broadly, for example, labels, tickets or slips.

However, along with the extension of uses, requirement for improvement of developed color preservative stability against natural environment such as heat, water or light, body fat when treated by hand, oil, plasticizer when put in a leather purse or solvent and requirement for good ground color are becoming more earnest, and must respond to these requirements.

For example, regarding preservative stability for an image part, it is known that resistance to plasticizer can be improved by using benzyloxalic acid esters compound, bisphenylsulfones compound and a compound possessing epoxy group (refer to patent document 1).

(Patent Document 1)

Japanese Patent Laid-Open Publication 4-164685 (claim)

Further, recently, the uses for a lottery ticket or a betting ticket of horse race are increasing. In these uses, since there is a possibility that one ticket becomes a bill of high amount, during a long effective term of the bill e.g. from 2 months to 1 year, reliability that the printed letters do not become unreadable or disappear is required. Especially, since these bills are usually kept in common living condition, for example, in cases when these bills are put on dash board of a car and exposed in high temperature atmosphere and ground color is developed or when these bills are wetted by water by spilling of water or hot water or are exposed to rain, it is important that the printed letters has a stability to be readable.

The object of the present invention is to provide a thermally sensitive recording medium which has high recording sensitivity, good heat resistance of ground color and good preservative stability of an image part.

DISCLOSURE OF THE INVENTION

The present invention is a thermally sensitive recording medium, comprising a thermally sensitive recording layer containing a colorless or pale colored basic colorless dye and an organic color developing agent as main components on a substrate, wherein said thermally sensitive recording layer contains at least one compound represented by general formula (1) and contains at least one compound selected from the group consisting of 3-{[(phenylamino)carbonyl]amino}benzensulfoneamide represented by formula (2), an ureaurethane compound represented by formula (3) and a copolymer of glysidilmethacrylate and vinyl monomer (average molecular weight is 9000-11000, epoxy equivalent is 300-600 and melting point is 110° C. or less) as a stabilizer.

(1)

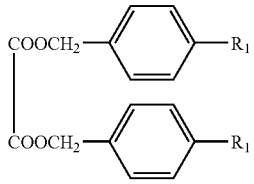

(in the formula, $R_1$ is a hydrogen atom, a halogen atom, an alkyl group or alkoxy group)

(2)

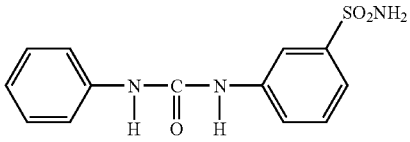

(3)

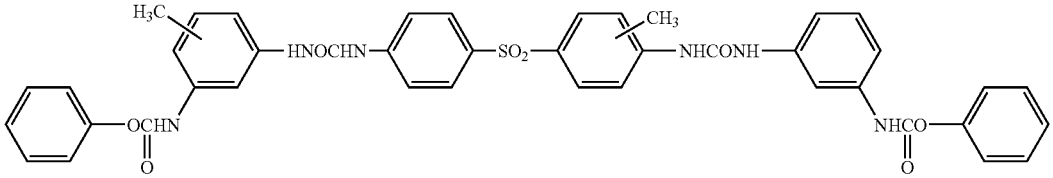

Further, in the thermally sensitive recording medium of the present invention, it is desirable to contain at least one compound represented by general formula (4) as an organic color developing agent.

(4)

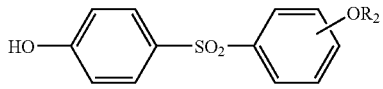

(in the formula, $R_2$ is an alkyl group of carbon number 1-4, an alkoxy group, a phenyl group or a hydrogen atom).

DESCRIPTION OF THE PREFERRED EMBODIMENT

In general, a thermally sensitive recording medium can be prepared by dispersing a colorless or pale colored basic colorless dye and a color developing agent respectively with a binder, adding additives such as a sensitizer, a filler, a UV absorbing agent, a water resisting agent or a defoaming agent when a need is arisen so as to prepare a coating and coating the obtained coating on a substrate then drying.

In the present invention, by using the compound represented by above general formula (1) as a sensitizer, it is possible to prepare a thermally sensitive recording medium having sufficient recording sensitivity and heat resistance. In general formula (1), $R_1$ indicates a hydrogen atom, a halogen atom, an alkyl group or an alkoxy group, and desirable carbon number of alkyl group and alkoxy group is 1-4.

As a specific example of the compound represented by general formula (1), dibenzyloxalate, di(p-chlorobenzyl)oxalate, di(p-methylbenzyl)oxalate or di(p-methoxybenzyl)oxalate can be mentioned, in particular, among these compounds, di(p-chlorobenzyl)oxalate is desirable.

Further, regarding the content of the compound represented by general formula (1), when the content is too small to that of a color developing agent, sufficient recording sensitivity can not be obtained and when the content is too much, heat resistance is obstructed. In the present invention, the desirable amount of the compound represented by general formula (1) is from 0.1 to 1.5 parts to 1 part of color developing agent.

developing sensitivity curve of the compound of general formula (1) used in the present invention is sharper than that of other sensitizer and does not easily develop color at lower energy or lower temperature region, while, at the region which is normally used for printing, strongly and radically develops color. Accordingly, in the thermally sensitive recording medium of the present invention, it is considered that at the temperature condition of 80° C., which is lower than printing energy color, color developing of ground color part does not occur and good heat resistance can be obtained. Still more, water solubility of the sensitizer represented by general formula (1) is low, and the stability of color developing substance formed by a basic dye and a color developing agent is high, therefore the resistance against water and a plasticizer is improved.

Furthermore, in the present invention, by using at least one compound selected from the group consisting of 3-{[(phenylamino)carbonyl]amino}benzensulfoneamide represented by formula (2), an ureaurethane compound represented by formula (3) and a copolymer of glysidilmethacrylate and vinyl monomer (average molecular weight is 9000-11000, epoxy equivalent is 300-600 and melting point is 110° C. or less) as a stabilizer, it is possible to improve the preservativity of recorded image against a plasticizer or others. When the content of these stabilizer is too small to the color developing agent, sufficient image preservativity of image can not be obtained and the content of these stabilizer is too much, the recording sensitivity is deteriorated. In the present invention, the specific example of the compound represented by general formula (3) can be mentioned as follows.

(3-1)

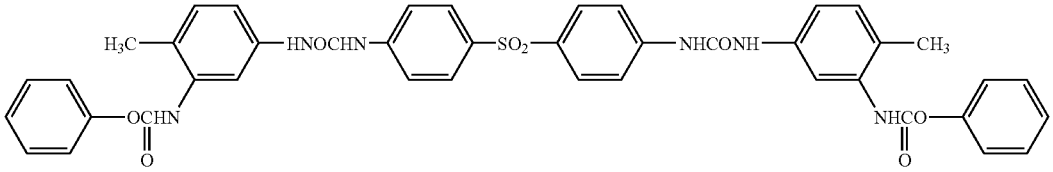

(3-2)

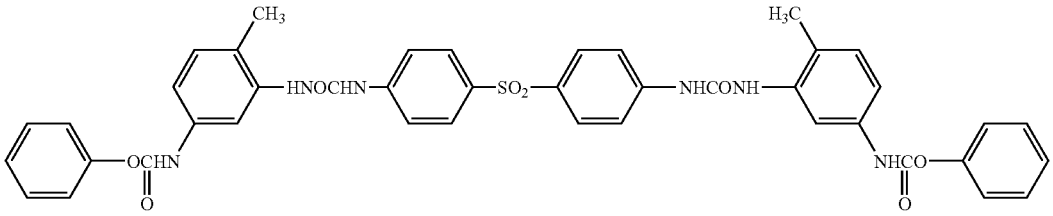

(3-3)

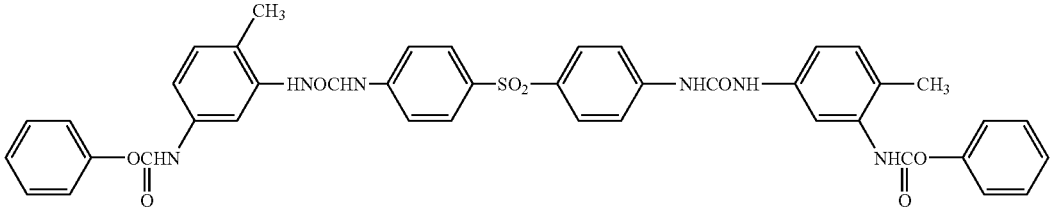

The reason why such an excellent effect is obtained is not clear, however, can be considered as follows. In general, there is a tendency that the heat resistance of ground color is deteriorated when a sensitizer is added, however, color Further, in a copolymer consisting of glysidilmethacrylate and vinyl monomer (average molecular weight is 9000-11000, epoxy equivalent is 300-600 and melting point is 110° C. or less), vinyl monomer means a monomer consisting of vinyl polymer and is specifically methylene, ethylene or propylene. Said kind of copolymer which can be used in the present invention, for example, can be purchased from Nagase Chemical Industries Co., Ltd., by commodity name NER-064.

In the thermally sensitive recording medium of the present invention, as the organic color developing agent, any kinds of public known agents in the field of thermally sensitive recording medium can be used, However, the compound represented by general formula (4) performs good heat resistance of ground color and is desirably used. In this case, since together use with a conventional color developing agent has a tendency to deteriorate heat resistance, it is better to avoid the together use with the conventional color developing agent.

In general formula (4), $R_2$ can be a substituting group which does not obstruct color developing effect, and as the specific example, an alkyl group of carbon number 1-4, an alkoxy group, a phenyl group or a hydrogen atom can be mentioned. As the specific examples represented by general formula (4), compounds of (4-1) to (4-11) can be mentioned, however, not limited to them. Among these compounds, compounds of (4-1), (4-2) or (4-6) are desirable used.

(4-1)

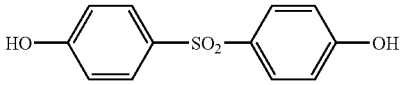

(4-2)

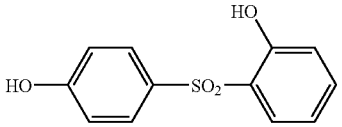

(4-3)

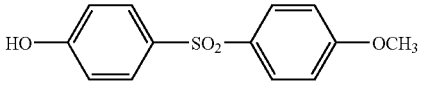

(4-4)

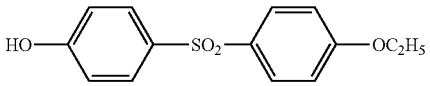

(4-5)

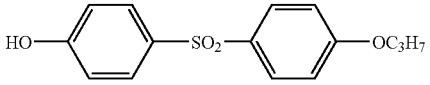

(4-6)

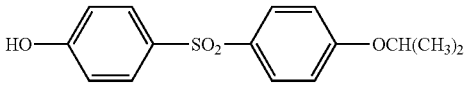

(4-7)

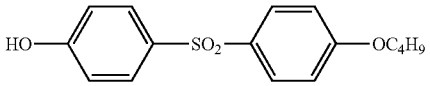

(4-8)

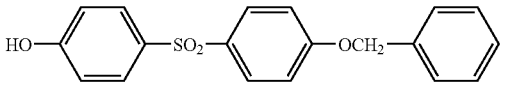

(4-9)

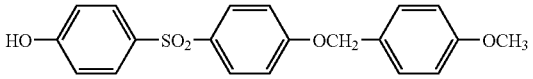

-continued (4-10)

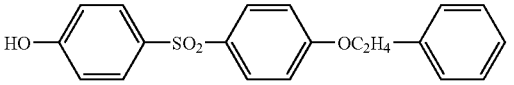

(4-11)

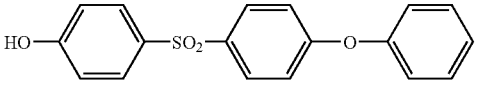

As the colorless or pale colored basic colorless dye used in the thermally sensitive recording medium of the present invention, any public known compounds in the field of thermally or pressure sensitive recording medium can be used and not restricted, however, the use of triphenylmethanes compound, fluorane compounds, fluorene compounds or divinyl compounds are desirable. Specific example of the colorless or pale colored basic colorless dye (dye precursor) are shown as follows. These dye precursors can be used alone or together with.

<Triphenylmethanes Leuco Dye>

3,3-bis(p-dimethylaminophenyl)-6-dimethylaminophthalide [another name is Crystal Violet Lactone]

3,3-bis(p-dimethylaminophenyl)phthalide [another name is Malachite Green Lactone]

<Fluorane Leuco Dyes>

3-diethylamino-6-methylfluorane 3-diethylamino-6-methyl-7-anilinofluorane 3-diethylamino-6-methyl-7-(o,p-dimethylanilino)fluorane 3-dibutylamino-6-methyl-fluorane 3-dibutylamino-6-methyl-7-anilinofluorane 3-dibutylamino-6-methyl-7-(o,p-dimethylanilino)fluorane 3-dibutylamino-6-methyl-7-(o-chloroanilino)fluorane 3-dibutylamino-6-methyl-7-(p-chloroanilino)fluorane 3-dibutylamino-6-methyl-7-(o-fluoroanilino)fluorane 3-dibutylamino-6-methyl-7-(m-trifluoromethylanilino)fluorane 3-dibutylamino-6-methyl-chlorofluorane 3-dibutylamino-6-ethoxyethyl-7-anilinofluorane 3-dibutylamino-6-chloro-7-anilinofluorane 3-(N-ethyl-N-isoamylamino)-6-methyl-7-anilinofluorane 3-(N-ethyl-N-isoamylamino)-6-chloro-7-anilinofluorane 3-(N-p-toryl-N-ethylamino)-6-methyl-7-anilinofluorane 3-cyclohexyl amino-6-chlorofluorane <Divinyl Type Leuco Dyes>

3,3-bis-[2-(p-dimethylaminophenyl)-2-(p-methoxyphenyl) ethenyl]-4,5,6,7-tetrabromophthalide 3,3-bis-[2-(p-dimethylaminophenyl)-2-(p-methoxyphenyl) ethenyl]-4,5,6,7-tetrachlorophthalide 3,3-bis-[1,1-bis(4-pyrrolidinophenyl)ethylene-2-yl]-4,5,6,7-tetrabromo phthalide 3,3-bis-[1-(4-methoxyphenyl)-1-(4-pyrrolidinophenyl)ethylene-2-yl]-4,5,6,7-tetrachlorophthalide <Others>

3-(4-diethylamino-2-ethoxyphenyl)-3-(1-ethyl-2-methylindol-3-yl)-4-azaphthalide 3-(4-diethylamino-2-ethoxyphenyl)-3-(1-octyl-2-methylindol-3-yl)-4-azaphthalide 3-(4-cyclohexylethylamino-2-methoxyphenyl)-3-(1-ethyl-2-methylindol-3-yl)-4-azaphthalide 3,3-bis(1-ethyl-2-methylindol-3-yl)phthalide 3,6-bis(diethylamino)fluorane-γ-(3'-nitro)anilinolactam 3,6-bis(diethylamino)fluorane-γ-(4'-nitro)anilinolactam
1,1-bis-[2',2',2",2"-tetrakis-(p-dimethylaminophenyl)-ethenyl]-2,2-dinitril ethane
1,1-bis-[2',2',2",2"-tetrakis-(p-dimethylaminophenyl)-ethenyl]-2-β-naphthoylethane
1,1-bis-[2',2',2",2"-tetrakis-(p-dimethylaminophenyl)-ethenyl]-2,2-diacetyl ethane
bis-[2,2,2',2'-tetrakis-(p-dimethylaminophenyl)-ethenyl]-methylmalonic acid dimethyl ester.

In the present invention, a well known sensitizer can be used in the limitation not to hurt the desirable effect of the present invention. As the example of the sensitizer,
fatty acid amide such as stearic acid amide or palmitic acid amide,
ethylenebisamide,
montan acid wax,
polyethylene wax,
1,2-di-(3-methylphenoxy)ethane,
p-benzylbiphenyl,
β-benzyloxynaphthalene,
4-biphenyl-p-tolylether,
m-tarphenyl,
1,2-diphenoxyethane,
dibenzyl4,4'-ethylenedioxy-bis-benzoate,
dibenzoyloxymethane,
1,2-di(3-methylphenoxy)ethylene,
1,2-diphenoxyethylene,
bis[2-(4-methoxy-phenoxy)]ethyl]ether,
p-nitromethylbenzoate,
dibenzylterephthalate,
benzyl p-benzyloxybenzoate,
di-p-tolylcarbonate,
phenyl-α-naphthylcarbonate,
1,4-diethoxynaphthalene,
phenyl 1-hydroxy-2-naphthoate,
o-xylene-bis-(phenylether) and
4-(m-methylphenoxymethyl)biphenyl can be mentioned, however, not intended to be limited to them. These sensitizers can be used alone or used together with.

As a binder to be used in the present invention, full saponificated polyvinyl alcohol of 200-1900 polymerization degree, partial saponificated polyvinyl alcohol, denatured polyvinyl alcohol by carboxyl, denatured polyvinyl alcohol by amide, denatured polyvinyl alcohol by sulfonic acid, denatured polyvinyl alcohol by butylal, other denatured polyvinyl alcohol, derivatives of cellulose such as hydroxyethyl cellulose, methyl cellulose, carboxymethyl cellulose, ethyl cellulose and acetyl cellulose, copolymer of styrene-maleic unhydride, copolymer of styrene-butadiene, polyvinyl chloride, polyvinyl acetal, polyacrylicamide, polyacrylic acid ester, polyvinylbutylal, polystyrene or copolymer of them, polyamide resin, silicon resin, petroleum resin, terpene resin, ketone resin and cumarone resin can be mentioned, however, not intended to be limited to them. These binders can be used alone or used together with. These macro molecule compounds can be applied by being dissolved into solvents such as water, alcohol, ketone, ester or hydrocarbon or by being dispersed in water or other medium under an emulsion state or a paste state and these forms of application can be used in combination according to the quality requirement.

As a filler which can be used in this invention, an inorganic filler such as silica, calcium carbonate, kaoline, calcined kaoline, diatomaceous earth, talc, titanium oxide, or aluminum hydroxide or an organic pigment can be mentioned. Further, a parting agent such as metallic salt of fatty acid, a slipping agent such as waxes, a UV absorbing agent of benzophenons or triazols, a water resisting agent such as glyoxal, a dispersing agent, a defoaming agent, an antioxidant or a fluorescent dye can be used.

Amount of a color developing agent and a dye used in the present invention and kind and amount of each components are decided according to the required ability and printing aptitude and not restricted, however, in general, from 0.1 to 2 parts of basic colorless dye and from 0.5 to 4 parts of filler are used to 1 part of color developing agent, and adequate amount of binder is from 5 to 25% in total solid.

A coating composed of above mentioned components is coated on the surface of voluntary substrate such as paper, synthetic paper, film or plastics, thus the aimed thermally sensitive recording sheet can be obtained. Further, for the purpose to enhance the preservativity, an overcoat layer of polymer can be provided on the thermally sensitive color developing layer. Said organic color developing agent, basic colorless dye and materials to be added when needs are arisen are pulverized by a ball mill, an attriter or a sand grinder, or by means of an adequate emulsifying apparatus, until they are pulverized to the under micron size, then add a binder and various additives according to the object and prepare a coating. Furthermore, for the purpose to enhance the color developing sensitivity, an undercoat layer of polymer containing a filler can be provided under the thermally sensitive color developing layer. Still further, for the purpose to prevent the permeation of water or oil from the back surface of paper, a back coat layer of polymer can be provided.

EXAMPLE

The thermally sensitive recording medium of the present invention will be illustrated more specifically according to the Examples. In the illustration, "parts" and % indicate "weight parts" and weight %.

Example 1

Dispersion of color developing agent (A solution), dispersion of basic colorless dye (B solution), dispersion of sensitizer (C solution) and dispersion of stabilizer (D solution) were ground respectively in wet condition to average particle diameter of 1 μm using a sand grinder.

| | |
|---|---|
| A solution (dispersion of color developing agent) | |
| compound (4-2) | 6.0 parts |
| 10% aqueous solution of polyvinyl alcohol | 18.8 parts |
| water | 11.2 parts |
| B solution (dispersion of basic colorless dye) | |
| 3-dibutylamino-6-methyl-7-anilinofluorane (OBD-2) | 2.0 parts |
| 10% aqueous solution of polyvinyl alcohol | 4.6 parts |
| water | 2.6 parts |
| C solution (dispersion of sensitizer) | |
| di(p-chlorobenzyl)oxalate | 6.0 parts |
| 10% aqueous solution of polyvinyl alcohol | 18.8 parts |
| water | 11.2 parts |
| D solution (dispersion of stabilizer) | |
| 3-{[(phenylamino)carbonyl]amino}benzensulfoneamide | 1.0 parts |
| 10% aqueous solution of polyvinyl alcohol | 2.3 parts |
| water | 1.3 parts |

Said dispersions are mixed by following ratio, stirred and a coating was prepared.

| | |
|---|---|
| A solution (dispersion of color developing agent [compound (4-2)] | 36.0 parts |
| B solution (dispersion of basic colorless dye [OBD-2]) | 9.2 parts |
| C solution (dispersion of sensitizer) | 36.0 parts |
| D solution (dispersion of stabilizer) | 4.6 parts |
| Kaolin clay (50% dispersion) | 12.0 parts |

Said coatings were coated respectively over the surface of paper of 50 g/m$^2$ and dried, then were treated by a super calendar so as the smoothness to become 500-600 sec. Thus the thermally sensitive recording medium of coating amount 6.0 g/m$^2$ was obtained.

Example 2

By same process to Example 1 except using compound (4-1) instead of compound (4-2) at the preparation of A solution (dispersion of color developing agent), thermally sensitive recording medium was obtained.

Example 3

By same process to Example 1 except using compound (4-1) instead of compound (4-2) at the preparation of A solution (dispersion of color developing agent) and using di(p-methylbenzyl)oxalate instead of di(p-chlorobenzyl)oxalate at the preparation of C solution (dispersion of sensitizer), thermally sensitive recording medium was obtained.

Example 4

By same process to Example 1 except using dibenzyloxalate instead of di(p-chlorobenzyl)oxalate at the preparation of C solution (dispersion of sensitizer), thermally sensitive recording medium was obtained.

Example 5

By same process to Example 1 except using compound (3-1) instead of 3-{[(phenylamino)carbonyl]amino}benzensulfoneamide at the preparation of D solution (dispersion of stabilizer), thermally sensitive recording medium was obtained.

Example 6

By same process to Example 1 except using a copolymer of copolymer of glysidilmethacrylate and vinyl monomer (average molecular weight is 9000-11000, epoxy equivalent is 300-600 and melting point is 110° C. or less, product of Nagase Chemical Industries Co., Ltd., commodity name NER-064), instead of 3-{[(phenylamino)carbonyl]amino}benzensulfone amide at the preparation of D solution (dispersion of stabilizer), thermally sensitive recording medium was obtained.

Comparative Example 1

By same process to Example 1 except not using dispersion of sensitizer C, thermally sensitive recording medium was obtained.

Comparative Example 2

By same process to Example 1 except not using dispersion of stabilizer D, thermally sensitive recording medium was obtained.

Comparative Example 3

By same process to Example 1 except using benzylparabenzyloxy-benzoate (melting point: 117° C.) instead of di(p-chlorobenzyl)oxalate (melting point: 118° C.) at the preparation of dispersion C (dispersion of sensitizer), thermally sensitive recording medium was obtained.

Comparative Example 4

By same process to Example 1 except using saturated fatty acid monoamide (22% dispersion, average particle size 0.5 μm, product of Chukyo Yushi Co., Ltd; commodity name G-270) instead of di(p-chlorobenzyl)oxalate (melting point: 117° C.) at the preparation of dispersion C (dispersion of sensitizer), thermally sensitive recording medium was obtained.

Comparative Example 5

By same process to Example 1 except using 4-benzyloxy-4-(2,3-epoxy-2-methylpropoxy)diphenylsulfone instead of 3-{[(phenylamino)carbonyl]amino}benzensulfoneamide at the preparation of dispersion D (dispersion of stabilizer), thermally sensitive recording medium was obtained.

Comparative Example 6

By same process to Example 1 except using di(p-methylbenzyl)oxalate (melting point: 117° C.) instead of di(p-chlorobenzyl)oxalate at the preparation of dispersion C (dispersion of sensitizer) and 4-benzyloxy-4-(2,3-epoxy-2-methylpropoxy)diphenylsulfone instead of 3-{[(phenylamino)carbonyl]amino}benzensulfoneamide at the preparation of dispersion D (dispersion of stabilizer), thermally sensitive recording medium was obtained.

<Evaluation of Thermally Sensitive Recording Medium>

The printing test is made on the prepared thermally sensitive recording media using thermally sensitive printer (thermal head of ROHN Co., Ltd., KM2004-A3 is installed) by 0.96 mJ/dot impressive energy. And obtained image and ground color are measured by means of a Macbeth Densitometer (RD-914). At the measurement, a filter is used as a filter of a Macbeth Densitometer. Heat resistance test, plasticizer resistance test and water resistance test are carried out on the obtained printed specimens. Detail of each measuring tests are illustrated as follows.

Heat resistance test: Obtained printed specimens are left in 80° C. and dry atmosphere for 24 hours and ground color is evaluated by a Macbeth Densitometer.

Plasticizer resistance test: Wrapping film of polyvinyl chloride (product of Mitsui Toatsu, Hiwrap KMA) is wound by one round and on said surface a printed specimen (printed by 0.219 mj/dot) is stuck so as the printed surface is on the face, then wrapping film of polyvinyl chloride is wound by triple rounds on it. Obtained specimen is left in 40° C. atmosphere for 24 hours and the recorded part is measured by a Macbeth Densitometer.

Water resistance test: Obtained printed specimen is dipped in water for 24 hours and dried. After that, Macbeth density of the printed part is measured.

The obtained results are summarized in Table 1.

TABLE 1

| | recording sensitivity | density of ground color | ground color part heat resistance | image part plasticizer resistance | image part water resistance |
|---|---|---|---|---|---|
| Example | | | | | |
| 1 | 1.38 | 0.05 | 0.09 | 0.80 | 1.35 |
| 2 | 1.35 | 0.05 | 0.09 | 0.82 | 1.31 |
| 3 | 1.39 | 0.05 | 0.10 | 0.89 | 1.33 |
| 4 | 1.38 | 0.05 | 0.09 | 0.83 | 1.35 |
| 5 | 1.36 | 0.05 | 0.11 | 0.98 | 1.35 |
| 6 | 1.35 | 0.05 | 0.10 | 088 | 1.33 |
| Comparative Example | | | | | |
| 1 | 0.43 | 0.05 | 0.07 | 0.20 | 0.39 |
| 2 | 1.31 | 0.05 | 0.09 | 0.20 | 1.29 |
| 3 | 1.35 | 0.05 | 0.10 | 0.72 | 0.35 |
| 4 | 1.39 | 0.05 | 0.15 | 0.65 | 0.65 |
| 5 | 1.32 | 0.05 | 0.25 | 0.75 | 1.27 |
| 6 | 1.31 | 0.05 | 0.23 | 0.79 | 1.19 |

As the evaluation test, printed specimens are dipped in 90° C. hot water for 5 seconds, image part and ground color are measured by a Macbeth Densitometer. At the measurement, Macbeth Densitometer filter is used too.

The obtained results are summarized in Table 2.

TABLE 2

| | hot water resistance image/ground color | remaining ratio of image | difference |
|---|---|---|---|
| Example | | | |
| 1 | 1.43/0.09 | 103.6 | 1.34 |
| 2 | 1.32/0.09 | 97.8 | 1.23 |
| 3 | 1.35/0.15 | 97.1 | 1.20 |
| 4 | 1.33/0.16 | 96.4 | 1.17 |
| 5 | 1.32/0.30 | 97.1 | 1.02 |
| 6 | 1.23/0.42 | 91.1 | 0.81 |
| Comparative Example | | | |
| 1 | 0.22/0.07 | 51.2 | 0.15 |
| 2 | 0.79/0.38 | 60.3 | 0.41 |
| 3 | 0.33/0.24 | 24.4 | 0.09 |
| 4 | 0.54/0.34 | 38.8 | 0.20 |
| 5 | 1.23/0.72 | 93.2 | 0.51 |
| 6 | 1.25/0.68 | 95.4 | 0.57 |

Remaining ratio of image is calculated by following numerical formula.

$$\text{Remaining ratio}(\%)=(\text{Macbeth density after test} \div \text{Macbeth density before test})\times 100$$

And, when ground color is bigger than 0.5, and the difference between image part and ground color part is smaller than 0.5, contrast is not so good and difficult to read.

<Evaluation Results>

From Examples 1-6 of the present invention, sufficient recording sensitivity, excellent heat resistance of ground color, excellent plasticizer resistance and water resistance of ground color are obtained. On the contrary, Comparative Example 1 which does not use the sensitizer of general formula (1), Comparative Examples 3 and 4 which use different sensitizer from that of the present invention and Comparative Examples 5 and 6 which use different stabilizer from that of the present invention are inferior to the present invention from the view point of balance between each quality performances.

Further, in detail, Comparative Example 1 indicates the case in which only 3-{[(phenylamino)carbonyl]amino}benzensulfoneamide (hereinafter shortened to SU), which is the stabilizer used in the present invention, is used and a sensitizer is not used. In this case, hot water resistance of ground color and heat resistance of ground color are good, however, water resistance is not sufficient and hot water resistance of image part and plasticizer resistance are bad. Comparative Example 2 indicates the case in which di(p-chlorobenzyl)oxalate (hereinafter shortened to HS) is used as a sensitizer and a stabilizer is not used. In this case, although water resistance is good, hot water resistance of image part and ground color are bad, further, plasticizer resistance is also bad. Comparative Examples 3 and 4 indicate the cases in which SU, which is the stabilizer used in the present invention, and well-known sensitizer (Comparative Examples 3 uses p-benzyloxybenzoate, Comparative Examples 4 uses afore mentioned saturated fatty acid monoamide) are used. In these cases, water resistance, hot water resistance of image part and hot water resistance of ground color are bad. Further, water resistance of ground color is insufficient. Comparative Examples 5 and 6 indicate the cases in which 4-benzyloxy-4-(2,3-epoxy-2-methylpropoxy)diphenylsulfone is used as a stabilizer and di(p-chlorobenzyl)oxalate or di(p-methylbenzyl)oxalate, which are the sensitizer used in the present invention, are used. In these cases, water resistance is deteriorated and hot water resistance of ground color is bad.

Above mentioned results are summarized in Table 3.

TABLE 3

| sensitizer | stabilizer | recording sensitivity | water resist. | hot water resist. image/G.C. | G.C. | water resist. G.C. | plasticizer resist. |
|---|---|---|---|---|---|---|---|
| | SU | X | X | X/○ | ○ | ○ | X |
| HS | | ○ | ○ | X/X | ○ | Δ | X |
| HS+ | SU | ○ | ○ | ○/○ | ○ | ○ | ○ |
| X+ | SU | ○ | X | X/X | ○ | Δ | Δ |
| HS+ | Y | ○ | Δ | Δ/X | ○ | X | Δ |

resist.: resistance,
G.C.: ground color

In the Table, X and Y mean well-known sensitizer or stabilizer which are not regulated in the present invention.

From Table 3, following conclusion can be derived.

HS is good at water resistance, however, is deteriorated by use of other stabilizer. Although SU is not good at water resistance, not hurt the water resistance of HS.

Both HS and SU are not good at hot water resistance of image part, however, by combining these two compounds, hot water resistance of image part can be improved. And said improvement of hot water resistance of image part is not sufficient or can not be obtained by combination of SU with other sensitizer or by combination of HS with other stabilizer.

Further, HS is not sufficient in heat resistance of ground color, while, SU is good, and heat resistance of ground color is improved only by combination use of HS and SU. When SU is combined with other sensitizer, heat resistance of ground color part is deteriorated.

Furthermore, when these two compounds are combined, plasticizer resistance is improved. When said compounds are respectively combined with other compound, above mentioned improving effect of plasticizer resistance can not be expected.

Above detailed conclusion are derived from the relationship between the sensitizer represented by general formula (1) and the stabilizer represented by formula (2). Regarding Example 5 which uses ureaurethane compound represented by general formula (3) as a stabilizer and Example 6 which uses a copolymer of glysidilmethacrylate and vinyl monomer, for example, hot water resistance can be explained as follows. That is, when used together with the sensitizer represented by general formula (1), does not indicate same excellent improving effect to the stabilizer represented by formula (2), however, compared with Comparative Example 5 which uses the sensitizer represented by general formula (1) and other stabilizer, is better because it is readable.

INDUSTRIAL APPLICABILITY

The thermally sensitive recording medium of the present invention has high recording sensitivity and good heat resistance of ground color. And since has excellent image stability against plasticizer, water or hot water without providing a protecting layer, the practicality of the present invention is excellent.

The invention claimed is:

1. A thermally sensitive recording medium, comprising a thermally sensitive recording layer on a substrate, said thermally sensitive recording layer consisting of a colorless or pale colored basic colorless dye and an organic color developing agent as main components, a sensitizer consisting of the compound di(p-chlorobenzyl)oxalic acid represented by general formula (1), (1)

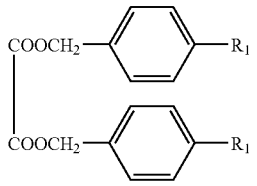

wherein, $R_1$ is a chlorine atom, and a stabilizer consisting of 3-{[(phenylamino)carbonyl]amino}benzensulfoneamide represented by formula (2), (2)

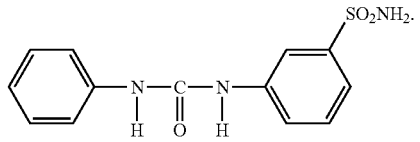

2. The thermally sensitive recording medium of claim 1, wherein the organic color developing agent consists of a compound represented by general formula (4), (4)

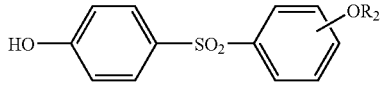

wherein, $R_2$ is an alkyl group of carbon number 1-4, an alkoxy group, a phenyl group or a hydrogen atom.

* * * * *